United States Patent [19]

Wycliffe

[11] Patent Number: 4,919,598

[45] Date of Patent: Apr. 24, 1990

[54] VACUUM PUMPS

[75] Inventor: Henryk Wycliffe, Crawley, England

[73] Assignee: The BOC Group, Inc., Murray Hill, New Providence, N.J.

[21] Appl. No.: 219,620

[22] Filed: Jul. 15, 1988

[30] Foreign Application Priority Data

Jul. 18, 1987 [GB] United Kingdom ..... 8717006

[51] Int. Cl.[5] ..... F04B 9/00

[52] U.S. Cl. ..... 417/362; 474/86; 123/198 C

[58] Field of Search ..... 417/362; 418/9; 474/86, 474/87, 133; 123/198 C

[56] References Cited

U.S. PATENT DOCUMENTS 2,069,327 2/1937 Ray et al. ..... 417/362 X
4,504,201 3/1985 Wycliffe ..... 418/9 X
4,511,378 4/1985 Greene ..... 417/362 X

FOREIGN PATENT DOCUMENTS

WO12288 5/1956 Fed. Rep. of Germany ..... 417/362
3706588 8/1988 Fed. Rep. of Germany ..... 417/362
54-074889 1/1981 Japan ..... 417/362

*Primary Examiner*—Leonard E. Smith
*Assistant Examiner*—Eugene L. Szczecia, Jr.
*Attorney, Agent, or Firm*—David M. Rosenblum; Larry R. Cassett

[57] ABSTRACT

In an oil free mechanical pump of the type in which two shafts support at least one pair of intermeshing rotors for rotation in opposite angular directions, a flexible drive means in the form of the belt or chain is provided for engaging pulleys or sprockets on the shafts.

3 Claims, 2 Drawing Sheets

VACUUM PUMPS

BACKGROUND OF THE INVENTION

This invention relates to vacuum pumps and is particularly directed to oil free mechanical vacuum pumps.

In order to improve the vacuum performance of such pumps, it is known to arrange a number of pumping stages in tandem and to include at the output stage and the stage immediately adjacent the output stage, rotors of intermeshing "claw" type.

In our United Kingdom Pat. No. 2111126, there is disclosed an oil free mechanical vacuum pump in which at least two pairs of rotors of the intermeshing "claw" type, are arranged in tandem in adjacent pumping chambers. In the pump disclosed and claimed in this United Kingdom Patent, each pair of rotors in a chamber are mounted on shafts driven to rotate in opposite angular directions, with the pairs of rotors in adjacent chambers being mounted upon the shafts in reverse orientation.

Such a pump construction has the advantage that by arranging the pairs of rotors in adjacent stages in reverse orientation, direct transfer of gas from one stage to the next through a transfer port in the partition walls separating adjacent stages, can occur with minimal interstage volume. The outlet of one stage on one side of the interstage partition, accordingly becomes the inlet of the next stage on the other side of the partition.

Conventionally, oil free mechanical pumps particularly of the type disclosed in United Kingdom Patent, No. 2,1111,26, have the rotor supporting shafts driven by suitably coupling one of the shafts, at one end, to a prime mover such as an electric motor and coupling the shafts, conveniently at an opposite end, through a gear train effective to produce rotation of the shafts in opposite angular directions.

A typical conventional shaft drive arrangement for such pumps is illustrated in FIG. 1 of the accompanying drawings. FIG. 1 illustrates two shafts, 2,4, of an oil free mechanical pump, driving pairs of "Claw" type rotors 6,8, supported upon the shafts in reverse orientation.

Extended drive shaft 2 is coupled to a prime mover such as an electric motor in any suitable manner (not shown), while drive shafts 2, 4 are coupled at the opposite end through engaging gears, 10,12 to provide rotation in opposite angular directions.

The gears 10,12 are correctly engaged for proper synchronization of the pairs of rotors 6,8 to ensure that the rotors do not touch in operation.

A number of disadvantages have been found to arise from the use of the gear train arrangement disclosed in FIG. 1:

Firstly, gears require lubrication to maintain efficient power transfer and to reduce to a minimum wear and consequent loss of synchronisation resulting from wear. The presence of oil is most detrimental in oil free mechanical pumps and costly oil seals, which require regular and expensive maintenance, are necessary to prevent oil transfer into the pumping chambers.

Secondly, most metal gear trains capable of transmitting the torque necessary to drive mechanical vacuum pumps, are in general very noisy and gear noise added to the noise of pump operation, often exceeds both tolerable and indeed statutory noise thresholds.

OBJECT OF THE INVENTION

It is accordingly one aid of the present invention to produce an oil free mechanical pump in which these disadvantages are reduced.

SUMMARY OF THE INVENTION

The present invention, according to its broadest aspect, provides an oil free mechanical pump of the type in which two shafts supporting at least one pair of intermeshing rotors are coupled for rotation in opposite angular directions by a flexible drive belt or chain engaging pulleys or sprockets on the shafts.

Suitably, the driving belt is an indented notched or ribbed belt of known kind, comprising fabric or metal reinforced rubber or polymer and having notches, indentations or ribs on at least one of the opposed surfaces, to enable it to engage co-operating sprockets or pulleys in order to drive them in opposite angular directions.

Alternatively, the drive of the present invention may be provided by a flexible chain, also of known kind and comprising fabric or metal reinforced rubber or polymer links. In this case, the chain engages sprockets on the shafts to ensure correct synchronisation of the pump rotors.

Suitably, the rotors which are driven through pulleys or sprockets by the flexible belt or chain of the present invention are meshing rotors of the "Claw" type. In this case, the driving belt of the present invention is indented notched or ribbed on each of its opposed surfaces, to reduce to a minimum the number of convolutions in the belt necessary to produce rotation of the rotor shafts in opposite angular directions.

In a preferred embodiment of the invention, the pump is an oil free pump having at least one pair of rotors of the "Claw" type provided in adjacent pumping chambers and mounted in reverse orientation to rotate in opposite angular directions.

Conveniently, the driving belt or chain of the present invention also is coupled to a prime mover so that both drive to the pump and between the shafts, can be simultaneously provided at one end only of the pump. In this way the overall length of the pump can be reduced by mounting the driving motor at the side or beneath the pump rather than at one axial end thereof.

BRIEF DESCRIPTION OF DRAWINGS

An embodiment of the invention will now be described by way of example with reference to the accompanying diagrammatic drawing in which.

DESCRIPTION OF PREFERRED EMBODIMENTS

Figure 1:
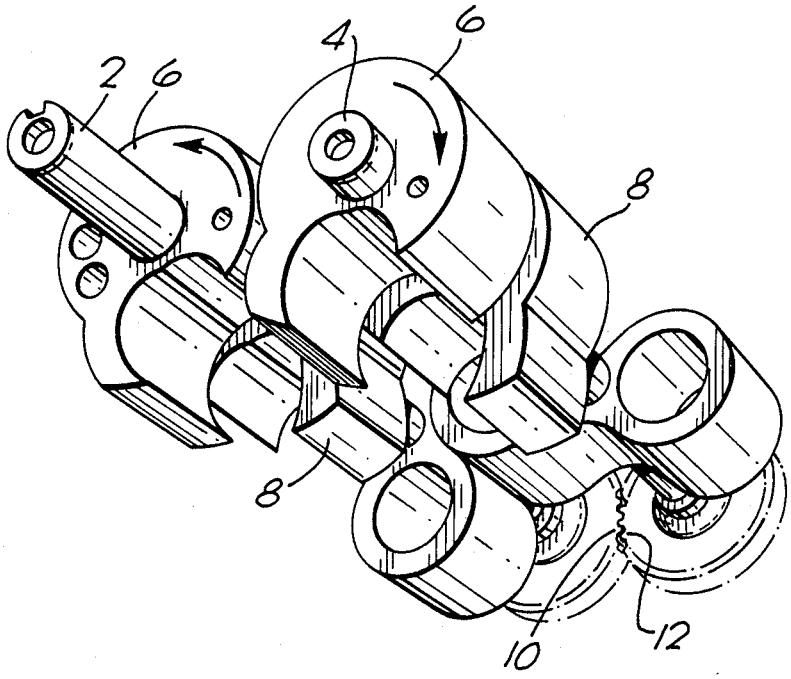
FIG. 1 (PRIOR ART)
FIG. 1 is a perspective view of the rotors of a conventional oil free mechanical vacuum pump embodying a known arrangement for coupling the pump rotors and, FIG. 2 is an end of view of a vacuum pump of the type shown in FIG. 1 but with claw type stages only and illustrating the rotor shaft coupling of the present invention.

The construction of an oil free mechanical pump of the kind with which the present invention is concerned, is described generally herein with reference to FIG. 1.

Specifically and as shown in FIG. 1, rotor pairs 6 and 8, disposed in independent pumping chambers in a manner well known in the art, are mounted upon shafts 2 and 4, which project through partition walls (not shown) separating one pumping chamber from the other and from the pump exterior.

Rotor pairs 6 and 8 are of the "Claw" type and are mounted upon the shafts 2 and 4 in reverse orientation in the manner disclosed and claimed in our United Kingdom Patent No. 2,111,126.

Rotor shaft 2 is extended at one end and is driven by a prime mover such as an electric motor secured to one axial end of the pump housing in the manner well known in the art.

To ensure that the rotor pairs 6 and 8 properly operate without mechanical contact, the shafts 2 and 4 are coupled at their opposite end by a gear train comprising intermeshing metal gears 10 and 12.

As herein described, such intermeshing metal gears necessary to transmit the torque required by the pump give rise to substantial problems, particularly in an oil free mechanical vacuum pump. These problems arise partly from the need to avoid the presence of any oil and partly are inherent in the properties of gears, such as noise and vibration.

Figure 2:
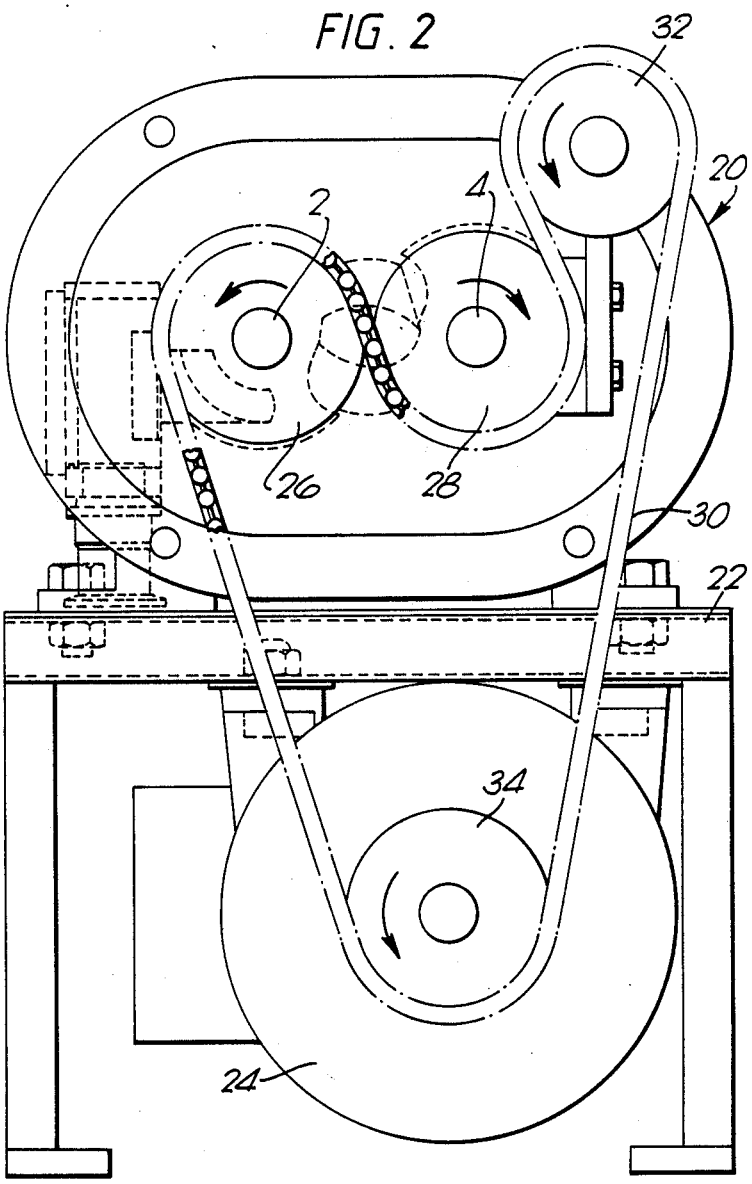

The problems arising from the use of a metal gear train are avoided by the shaft coupling and driving arrangement illustrated in FIG. 2 of the accompanying drawings. As shown in FIG. 2 of the drawings, the dry pump indicated generally at 20, is supported upon a stand 22, on which the pump prime mover, in the form of an electric motor 24, is mounted.

The stub ends of shafts 2 and 4 of the pump illustrated in FIG. 1 carry indented pulleys 26 and 28 adapted to engage opposite surfaces of a ribbed or otherwise indented belt 30, having corresponding ribs or indentations on each of its opposite operating surfaces. The belt 30, is of a type well known in the art comprising fabric or metal reinforced rubber or polymer and is selected to provide the maximum engagement and power transfer without slip, while displaying the minimum of elongation, either with applied tension or as a result of extended use.

As illustrated in FIG. 2, belt 30 is looped around pulleys 26 and 28 to provide rotation of shafts 2 and 4 in opposite angular directions and to ensure that the rotor pairs 6 and 8 mounted upon the shafts as illustrated in FIG. 1, rotate in the correct direction without mechanical contact.

Belt 30 also passes over a tensioning idler pulley 32, which may also be indented and is driven to rotate the shafts 2 and 4 by also passing over an indented pulley 34 provided on the drive shaft of motor 24.

The use of the pulley-belt combination of the present invention obviates the need for oil lubrication which would adversely effect the cleanliness of the pump and indeed of any oil free mechanical vacuum pump and also considerably reduces the noise hazard and cost arising from the operation of such pumps.

It will be appreciated that the present invention displays a number of advantages over conventionally driven and coupled oil free vacuum pumps; for example it reduces the overall length of the pump which can be of considerable advantage in restricted spaces, it eliminates the risk arising from the leakage or seepage of lubricants into the pump and considerably reduces the hazard of noise generating during conventional pump operation.

It will also be appreciated that while the invention has been described with reference to belt drive, the use of flexible chaining comprising fabric or metal reinforced rubber or polymer is also within the scope of the invention.

It will also be appreciated that while the drive shaft coupling and driving arrangement of the present invention has been described with reference to oil free mechanical vacuum pumps employing rotors of the intermeshing "Claw" type, it is equally applicable to any oil free mechanical, or indeed any other pump in which the problems arising from the use of metal gear power transfer are displayed.

I claim:

1. In an oil free mechanical vacuum pump including a pair of rotatable shaft supporting at least one pair of intermeshing rotors, the improvement comprising: a pair of spaced apart, rotatable driven means attached to the shafts and each having a circumference adapted to be driven for rotating the shafts; and flexible, band-like drive means passing between the driven means and on opposite sides thereof circumferentially engaged with the pair of driven means for driving the driven means and therefore, the shafts and rotors for rotation in opposite angular directions; the drive and pair of driven means having coating means for preventing slippage therebetween.

2. The improvement of claim 1, wherein;

the drive and pair of driven means are respectively formed by a belt and a pair of pulleys; and coating means comprises the belt having a pair of opposed, alternately ribbed and indented operating surfaces and the circumferences of the pulley having alternately ribbed an indented circumferential surfaces engaged with the operating surface of the belt.

3. The improvement of claim 5 wherein:

the drive and pair of driven means respectively comprises a chain having links and a pair of sprockets having teeth engaged with the links of the chain.

the coacting means comprises the engagement between the sprocket teeth and the links of the chain.

* * * * *